US010914266B2

(12) United States Patent
Rolandson

(10) Patent No.: US 10,914,266 B2
(45) Date of Patent: Feb. 9, 2021

(54) TWO STAGE COMPACT EVAPORATOR FOR VEHICLE WASTE HEAT RECOVERY SYSTEM

(71) Applicant: VOLVO CAR CORPORATION, Gothenburg (SE)

(72) Inventor: Ola Rolandson, Vänersnäs (SE)

(73) Assignee: VOLVO CAR CORPORATION, Gothenburg (SE)

( * ) Notice: Subject to any disclaimer, the term of this patent is extended or adjusted under 35 U.S.C. 154(b) by 64 days.

(21) Appl. No.: 16/277,490

(22) Filed: Feb. 15, 2019

(65) Prior Publication Data

US 2020/0141352 A1 May 7, 2020

Related U.S. Application Data

(60) Provisional application No. 62/755,734, filed on Nov. 5, 2018.

(51) Int. Cl.
*F02G 5/02* (2006.01)
*F25B 5/04* (2006.01)
(Continued)

(52) U.S. Cl.
CPC ..... *F02G 5/02* (2013.01); *F25B 5/04* (2013.01); *F25B 27/02* (2013.01); *F25B 39/02* (2013.01); *F25B 43/00* (2013.01)

(58) Field of Classification Search
CPC .... F02G 5/02; F25B 5/04; F25B 27/02; F25B 39/02; F25B 43/00
See application file for complete search history.

(56) References Cited

U.S. PATENT DOCUMENTS 7,373,904 B2 * 5/2008 Bharathan ..... F01K 25/06 122/489
8,176,738 B2 * 5/2012 Kalina ..... F22B 1/18 60/649
(Continued)

FOREIGN PATENT DOCUMENTS

CN 108643981 A 10/2018
JP H01285609 A 11/1989
(Continued)

OTHER PUBLICATIONS

English Translation JP-2000161018-A (Year: 2000).*

*Primary Examiner* — Shafiq Mian
(74) *Attorney, Agent, or Firm* — Berenato & White, LLC

(57) ABSTRACT

A compact two-stage evaporator waste heat recovery (WHR) device (7) is disclosed, and a system using the device. The device recovers energy from waste heat passing through the device and transfers that energy to a Rankine Cycle working fluid also passing through the device. The device includes a first and second evaporator (15); and, a state separator (17) connected between the outlet of the first evaporator and the inlet of the second evaporator. The state separator (17) separates the working fluid into liquid and vapor. The liquid is re-cycled to the inlet of the first evaporator (15); the vapor is sent to the inlet of the second evaporator (19) for superheating. An overall WHR system using the device further includes an expander (21), condenser (23), and pump (25). The system further includes control circuitry (26) for controlling operation of the waste heat recovery device (7) itself and the WHR system.

18 Claims, 9 Drawing Sheets

(51) Int. Cl.

| | |
|---|---|
| ***F25B 27/02*** | (2006.01) |
| ***F25B 39/02*** | (2006.01) |
| ***F25B 43/00*** | (2006.01) |

(56) References Cited

U.S. PATENT DOCUMENTS

| | | | | |
|---|---|---|---|---|
| 8,833,077 | B2 * | 9/2014 | Kalina | F01K 25/06 60/649 |
| 2005/0183418 | A1 * | 8/2005 | Kalina | F01K 25/065 60/517 |
| 2006/0113693 | A1 * | 6/2006 | McBain | B29C 45/1679 264/40.1 |
| 2006/0207255 | A1 * | 9/2006 | Bottger | F01K 25/065 60/641.2 |
| 2007/0234750 | A1 * | 10/2007 | Kalina | F25J 1/0296 62/272 |
| 2010/0263380 | A1 * | 10/2010 | Biederman | F01K 25/08 60/651 |
| 2010/0281865 | A1 * | 11/2010 | Lehar | F01K 23/10 60/671 |
| 2015/0052895 | A1 * | 2/2015 | Hsu | F01K 13/003 60/645 |
| 2016/0084115 | A1 * | 3/2016 | Ludewig | F01K 7/16 60/651 |
| 2017/0130633 | A1 | 5/2017 | Andersson et al. | |
| 2017/0356386 | A1 | 12/2017 | Hombsch et al. | |

FOREIGN PATENT DOCUMENTS

| | | | |
|---|---|---|---|
| JP | 2000161018 | A * | 6/2000 |
| JP | 2014190277 | A | 10/2014 |

* cited by examiner

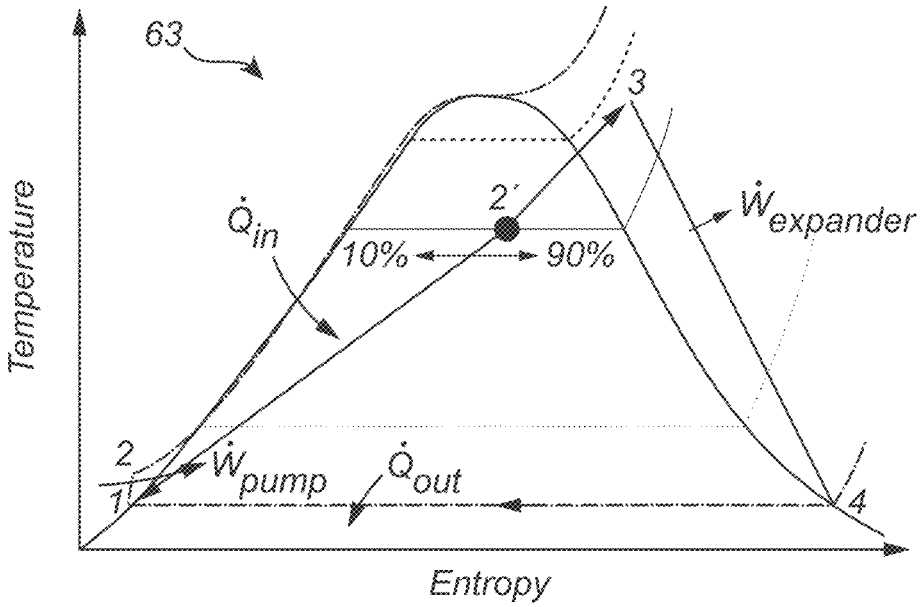
Fig. 4
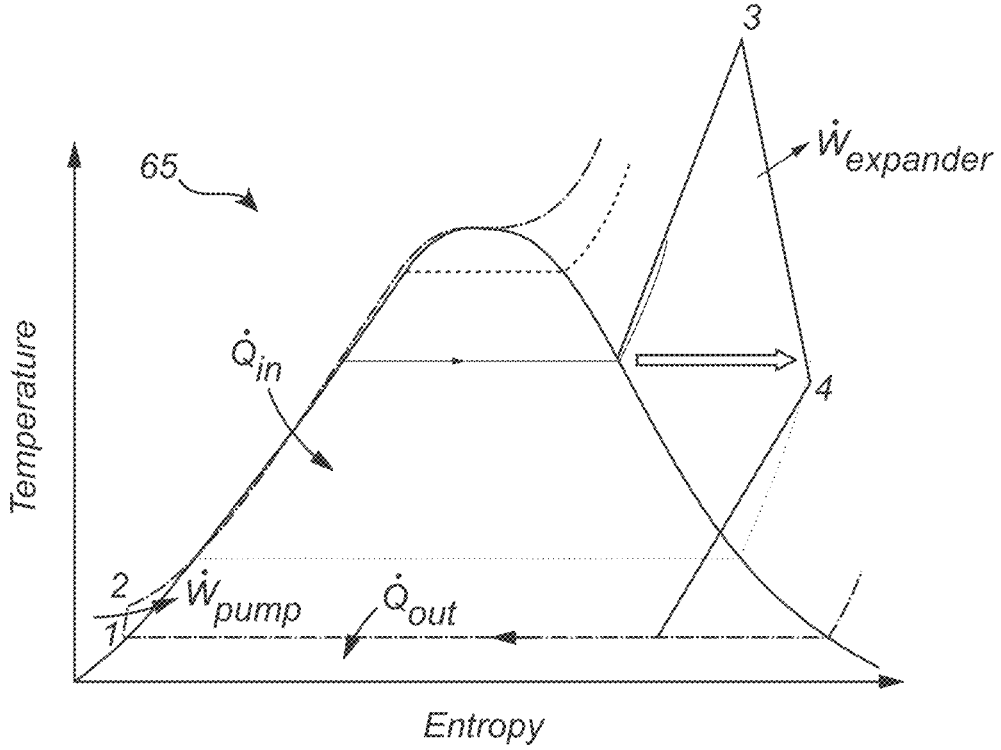
(Related art) Fig. 5

TWO STAGE COMPACT EVAPORATOR FOR VEHICLE WASTE HEAT RECOVERY SYSTEM

RELATED CASES

The present claims the benefit of U.S. Provisional application Ser. 62/755,734, filed Nov. 5, 2018, which is incorporated herein by reference.

TECHNICAL FIELD

The present invention relates to a two-stage compact evaporator for installation in a waste heat recovery system for a vehicle, and to a vehicle including such a waste heat recovery system.

BACKGROUND OF THE INVENTION

When internal combustion engines (ICEs) are in operation, considerable heat is generated. Vehicles using ICEs discharge heat energy into the external environment through, for example, exhaust gas, engine cooling systems, charge air cooling systems. The discharged heat energy that is not used to perform useful work is typically known as "waste heat". Waste heat recovery (WHR) systems capture a portion of the waste heat to perform useful work, such as generating electrical energy via an expander (e g., a turbine) coupled to a generator. Some WHR systems use a Rankine cycle (RC). The RC is a thermodynamic process in which heat is transferred to a working fluid in an RC circuit. The working fluid is first pumped to an evaporator where it is vaporized during a heating phase. The vapor phase working fluid is then passed through an expander and then back through a condenser, where the vapor phase working fluid is condensed back to liquid phase working fluid. The process is then repeated. The expander may, for example, drive a generator to generate electrical energy.

An Organic Rankine cycle (ORC) is an alternative version of an RC in which the working fluid is an organic, high molecular mass, fluid with a liquid-vapor phase change at a lower temperature, 74 Celsius, than that of water, 100 Celsius. For example: an alcohol. Such a fluid allows for heat recovery from relatively lower temperature sources relative to other RC systems. An additional advantage of an ORC is that such systems are both more freeze resistant, an important consideration in vehicle applications, and absorb heat more quickly and thus arrive at a working phase more quickly.

In any RC system, to both prevent damage to the expander and enhance energy recovery efficiency, the vapor phase working fluid may be "superheated" to eliminate any fluid droplets before being provided to the expander. This may, for example, be achieved using first and second evaporators connected in series. An example T-S diagram for a WHR system with a first evaporator producing saturated steam, and a second evaporator superheating the steam is shown, for example, in FIG. 5. As noted, this superheating is useful for both preventing damage to the expander and is desirable to additionally provide for more efficient energy conversion (as shown by the expanded area within the RC phase diagram).

SUMMARY

In view of above-mentioned and other drawbacks of the prior art, it is an object of the present invention to provide an improved WHR ORC system. Such an improved system would include a compact two-stage evaporator including a state separator, or at least a state separator function, between the respective first and second evaporators. By using such a compact evaporator, a WHR ORC system can make better use of a water/organic blend working fluid. The organic component of the working fluid provides rapid start-up to a working vapor phase and retains the benefits of enhanced freeze prevention. The water component retains the advantages of water-based vapor having a higher working temp and being a more robust retainer of heat. The evaporator includes controlled processing of a state separator function between the respective first and second stage evaporators to prevent fluid droplets from entering the second evaporator and downstream expander especially during the start-up phase of the WHR system.

According to the present invention, it is therefore provided an enhanced waste heat recovery system for a vehicle, for converting thermal energy generated in the vehicle to mechanical energy for assisting more efficient operation of the vehicle. The WHR system includes a compact two-stage evaporator, having: 1) a first evaporator, for evaporating liquid state working fluid to a saturated vapor state working fluid through supply of heat from a first vehicle heat source; 2) a state separator, or a controlled state separator function, for separating vapor state working fluid and liquid state working fluid; and, 3) a second evaporator, connected to the vapor outlet of the state separator, for superheating vapor state working fluid through supply of additional heat from a second vehicle heat source.

The overall WHR system further including, downstream from the second evaporator, an expander for expanding the superheated vapor state working fluid and converting that expansion into mechanical energy for assisting, for example, propulsion of the vehicle. The expander outlet being in fluid connection with a condenser for condensing the vapor state working fluid back into liquid state working fluid by cooling. A pump is also provided so that fluid may flow from the outlet of the condenser to the inlet of the first evaporator so as to be re-cycled through the RC. Control circuitry for controlling overall operation of the waste heat recovery system and for particularly controlling the state separator function during initial start-up when moisture droplets is also present.

The expander may be any device capable of expanding vapor state working fluid and converting the expansion of the vapor state working fluid to mechanical energy. The expander may, for instance, comprise a turbine or a piston arrangement.

The control circuitry may advantageously comprise processing circuitry which may include at least one microprocessor and a memory. The memory may contain a set of instructions for the microprocessor, and the microprocessor may control operation of the waste heat recovery system based on the set of instructions.

The present invention is premised upon the realization that a more energy efficient conversion in a WHR blended ORC system is made possible by arranging a state separator device/function between a compact first evaporator and a second evaporator in such a way that only vapor phase working fluid enters the second evaporator, while liquid phase working fluid, thus separated, is fed back into the first evaporator and by-passes the expander. Through this configuration, the desired superheated vapor working fluid for the expander can be formed with addition of less heat than if a mix of vapor phase and liquid phase working fluid entered the second expander. The waste heat recovery system according to embodiments of the present invention can function most efficiently with a working fluid that is a mix of a first working fluid with a first boiling temperature and a second working fluid with a second boiling point, different from the first boiling point. Through a suitable selection of first and second (or more) working fluids, the waste heat recovery system can be made to function at lower temperatures, which may be beneficial in many applications, in particular vehicle applications. For instance, where a mix of water and ethanol may be used as the working fluid. Furthermore, the provision of the state separator allows feedback control of the waste heat recovery system to achieve more efficient transfer of heat to the working fluid in the first evaporator According to various embodiments, the first outlet of the state separator may be fluid flow connected to the inlet of the first evaporator via a/the system pump. In other words, the waste heat recovery system may include a fluid conduit from the first outlet of the state separator to the conduit connecting the condenser and the pump. In these embodiments, the pump assists in maintaining a feedback flow of liquid state working fluid from the first outlet of the state separator to the inlet of the first evaporator. Alternatively, or in combination, an additional pump may be provided along the return conduit connected to the first outlet of the state separator.

In further embodiments, the state separator function may be configured to separate vapor state working fluid and liquid state working fluid based on density. For instance, the state separator may use one of several, per se, well-known principles for liquid phase and vapor phase working fluid as used in so-called steam traps. According to one example, the state separator may comprise a float with a density between the densities of liquid state working fluid and vapor state working fluid. The float may be connected to a valve, so that the valve is operated based on the level of liquid state working fluid in a chamber in the state separator.

Advantageously, the waste heat recovery system may further comprise a sensor for providing a signal indicative of mass flow of liquid state working fluid from the first outlet of the state separator to the inlet of the first evaporator. The control circuitry may be electrically connected to the sensor and to the pump, and configured to: acquire, from the sensor, the signal indicative of mass flow of liquid state working fluid from the first outlet of the state separator to the inlet of the first evaporator; and control the pump to supply a sufficient mass flow of liquid state working fluid to the inlet of the first evaporator to make mass flow of liquid state working fluid from the first outlet of the state separator to the inlet of the first evaporator greater than zero. Accordingly, it may be sufficient that the above-mentioned sensor provides a signal indicative of the presence of mass flow of liquid state working fluid. To facilitate control of the pump, it may however be advantageous if the above-mentioned sensor is configured to provide a signal indicative of a magnitude of the mass flow.

Using feedback control of the pump to maintain mass flow of liquid phase working fluid from the first outlet of the state separator, efficient heat transfer in the first evaporator can be provided for. In particular, the working fluid can be maintained in its saturated state in the first evaporator, before a steam film can be created on the first evaporator surface and act as insulation, reducing the heat flux from the first vehicle heat source to the working fluid in the first evaporator.

The above-mentioned sensor may, for example, be a liquid sensor arranged along the return conduit connected to the first outlet of the state separator.

Moreover, the waste heat recovery system according to various embodiments of the present invention may be included in a vehicle, further comprising: a first vehicle heat source; and a second vehicle heat source, wherein: the first evaporator of the waste heat recovery system is in thermal contact with the first vehicle heat source; and the second evaporator of the waste heat recovery system is in thermal contact with the second vehicle heat source. The second vehicle heat source may be spaced apart from the first vehicle heat source.

Depending on various factors, such as the configuration of the waste heat recovery system and the selection of working fluid (such as a suitable mix of fluids), different temperatures of the first and second vehicle heat sources may be sufficient to eliminate fluid droplets, i.e., non-vapor phase working fluid, from passing through the second evaporator to the downstream expander.

According to various embodiments, the vehicle may comprise an internal combustion engine and an exhaust system; the first vehicle heat source may be constituted by a first portion of the exhaust system; and the second vehicle heat source may be constituted by a second portion of the exhaust system.

The second portion of the exhaust system may be upstream of the first portion of the exhaust system.

In summary, according to various embodiments, the present invention installed on a vehicle WHR system would include: a first evaporator; a state separator function/device having an inlet connected to an outlet of the first evaporator, a first outlet connected to an inlet of the first evaporator for providing liquid state working fluid to the inlet of the first evaporator, and a second outlet for output of vapor state working fluid. A second evaporator connected to the second outlet of the state separator; an expander connected to an outlet of the second evaporator; a condenser connected to an outlet of the expander; and, a fluid pump connected to an outlet of the condenser and the inlet of the first evaporator for transporting liquid state working fluid from the outlet of the condenser to the inlet of the first evaporator. The installed system would also include control circuitry for controlling operation of the waste heat recovery system in conjunction with distinct operational phases of the vehicle; i.e., initial start-up; continuous cruise, shut-down, high demand.

Other aspects of the invention will become more apparent upon reading the following detailed description of the exemplary embodiments.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In these drawings:

FIG. 4 is an exemplary T-S diagram for an RC system;

FIG. 5 is a T-S diagram for an RC system using a second superheating phase according to related art.

DESCRIPTION OF EMBODIMENTS

Figure 1:
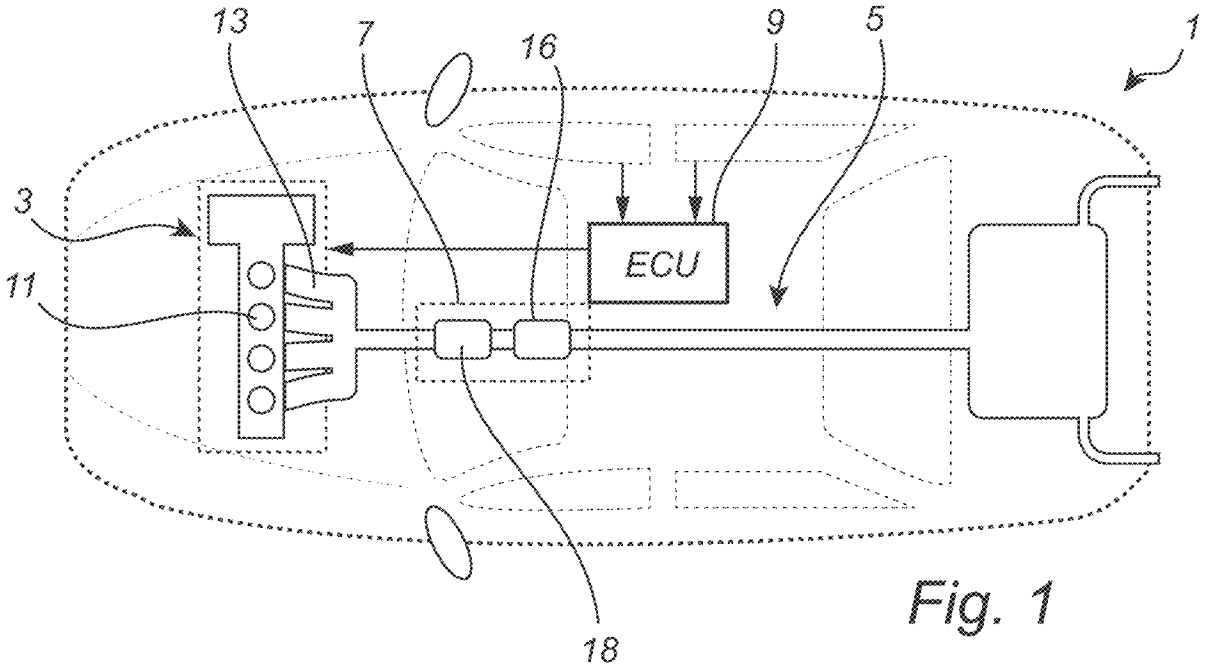
FIG. 1 schematically shows a vehicle according to an example embodiment of the present invention.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "front," "rear," "left," "right," "upper," "lower," "top," and "bottom" as well as derivatives thereof (e.g., "horizontally," "downwardly," "upwardly," etc.) should be construed to refer to the orientation as then described or as shown in the drawing figure under discussion and to the orientation relative to a vehicle body. These relative terms are for convenience of description and normally are not intended to require a particular orientation. Terms concerning attachments, coupling and the like, such as "connected" and "interconnected", refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. The term "integral" (or "unitary") relates to a part made as a single part, or a part made of separate components fixedly (i.e., non-moveably) connected together. Additionally, the words "a" and/or "an" as used in the claims mean "at least one" and the word "two" as used in the claims means "at least two". For the purpose of clarity, some technical material that is known in the related art has not been described in detail in order to avoid unnecessarily obscuring the disclosure.

FIG. 1 schematically shows a vehicle, here in the form of a car 1, according to an example embodiment of the present invention. Referring to FIG. 1, the vehicle 1 comprises an internal combustion engine (ICE) 3, an exhaust system 5, a waste heat recovery system (WHR system) 7, and an engine control unit (ECU) 4 for controlling operation of the ICE 3.

The ICE 3 comprises at least one combustion chamber 11 (generally one combustion chamber per cylinder for an ICE comprising multi-cylinders), and an exhaust manifold 13. Combustion in the combustion chamber results in exhaust fumes, which are evacuated from the combustion chamber 11 into the exhaust manifold 13.

As is schematically indicated in FIG. 1, different parts of the exemplary WHR system 7 are arranged to receive heat from a first vehicle heat source 16 and a second vehicle heat source 18 arranged along the exhaust system 5. As is customary for WHR systems 7, it should be understood that the WHR system 7 in FIG. 1 is configured to return energy to the vehicle 1 in the form of electrical energy or propulsion. The WHR system, or at least the specific heat capturing elements, i.e., the evaporators, are installed as close as is practicable to, or as a part of, the ICE exhaust manifold/exhaust where the heart source will be most concentrated.

Figure 2:
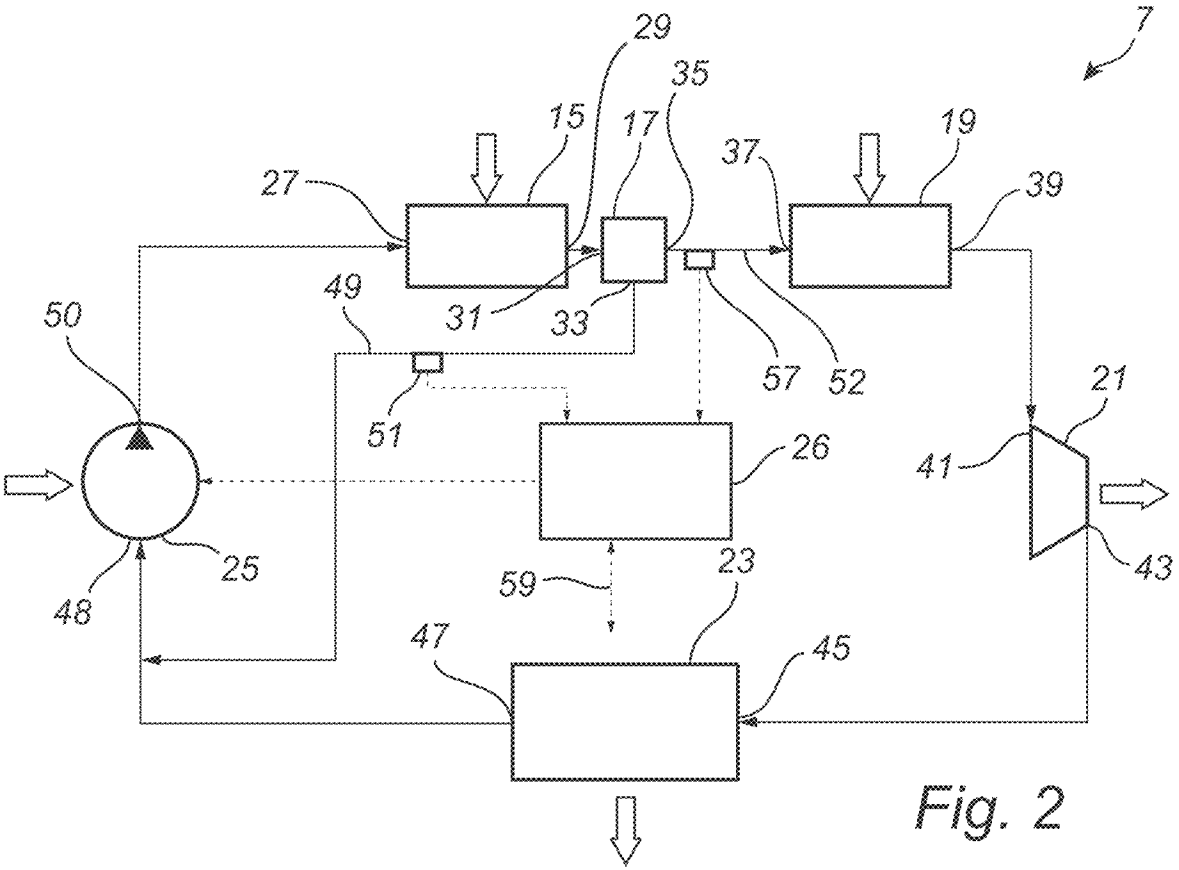
FIG. 2 is a schematic functional illustration of the waste heat recovery system according to an example embodiment of the present invention.

FIG. 2 is a schematic functional illustration of an entire WHR system 7, including the compact two-stage evaporator, according to an example embodiment of the present invention. Referring to FIG. 2, the WHR system 7 comprises a first evaporator 15, a state separator 17, a second evaporator 19, an expander 21, a condenser 23, a pump 25, and a control unit 26. The block arrows indicate flow of heat energy into the first 15 and second 19 evaporators and out of the condenser 23, and flow or work into the pump 25 and out of the expander 21.

The first evaporator 15 has an inlet 27 for receiving liquid state working fluid, and an outlet 29 for output of saturated vapor state working fluid, typically mixed with liquid state working fluid, following supply of heat in the first evaporator 15 from the first vehicle heat source 16. The state separator 17, which is configured to receive a mix of vapor state working fluid and liquid state working fluid, and to separate this mix into pure vapor state working fluid and pure liquid state working fluid, has an inlet 31 for fluid flow, connected to the outlet 29 of the first evaporator 15, a first outlet 33, for output of liquid phase working fluid, and a second outlet 35 for output of vapor phase working fluid.

As is schematically indicated in FIG. 2, the first outlet 33, of the state separator 17, is connected to a return conduit 49 for feeding back liquid state working fluid towards the inlet 27 of the first evaporator 15. The second outlet 35, of the state separator 17, is connected to the inlet 37 of the second evaporator for providing vapor phase working fluid to the second evaporator 19. Along the return conduit 49, there is provided a sensor 51 for providing a signal indicative of mass flow of liquid state working fluid through the return conduit 49. Along the conduit 52, connecting the second outlet 35 of the state separator 17 with the inlet 37 of the second evaporator 19, there is provided a temperature sensor 57 for providing a signal indicative of the temperature of the vapor phase working fluid flowing through the conduit 52.

The outlet 39, of the second evaporator 19, is fluid flow connected to the inlet 41 of the expander 21, which may for example be a piston-based expander or a turbine. The outlet 43, of the expander 21, is fluid flow connected to the inlet 45 of the condenser 23. The outlet 47 of the condenser 23 is fluid flow connected to the inlet 48 of the pump 25. Finally, the outlet 50 of the pump 25 is fluid flow connected to the inlet 27 of the first evaporator 15.

As is schematically indicated in FIG. 2, the control unit 26 is connected to the above-mentioned sensors 51, 57, the pump 25, and external circuitry as represented by the double-ended arrow 59. Such external circuitry may, for example, include the ECU 9, and/or various additional sensors monitoring temperature and density and flow rate.

In the example embodiment of the WHR system 7 in FIG. 2, the return conduit 49 from the first outlet 33 of the state separator 17 is shown to be fluid flow connected to the inlet 27 of the first evaporator 15 via the pump 25. In other words, the first outlet 33 of the state separator 17 is fluid flow connected to the inlet 48 of the pump 25, and liquid state working fluid flowing through the return conduit 49 is provided to the first inlet 27 of the first evaporator 15 by the pump 25.

The vapor state working fluid that is provided to the inlet 37 of the second evaporator 19 is superheated through supply of heat from the second vehicle heat source 18, and the superheated vapor phase working fluid is provided to the inlet 41 of the expander 21 at a first pressure. The expander 21 expands the vapor phase working fluid and outputs vapor phase working fluid at a second pressure, lower than the first pressure, through the outlet 43 of the expander 21. The expansion of the vapor phase working fluid is converted to work by the expander 21. The work is used for operation of the vehicle 1, either directly, or following conversion to electrical energy.

The expanded vapor state working fluid is provided to the inlet 45 of the condenser 23. The condenser 23 condenses the vapor state working fluid to liquid state working fluid, and outputs liquid state working fluid through the outlet 47. The liquid state working fluid from the condenser 23, together with the fed-back liquid state working fluid from the state separator 17 is pumped by the pump 25 towards the inlet 27 of the first evaporator 15.

In a vehicle 1, the heat power available from the first 16 and second 18 vehicle heat sources will vary depending on the current operating point of the vehicle 1. For increased efficiency of the WHR system 7, and consequently of the vehicle 1, the operation of the WHR system 7 may be adapted to optimize heat extraction from the vehicle heat sources during various phases of vehicle operation.

Considering, for example, the case when the heat power supplied by the first vehicle heat source 16 is increased, the first evaporator 15 may be capable, wholly by itself, of converting the liquid state vapor phase working fluid supplied through the inlet 27 to superheated vapor phase working fluid, so that the flow of liquid state working fluid through the return conduit 49 ceases. In this situation, however, so-called film boiling at least partly occurs in the first evaporator 15, which reduces the heat flux to the working fluid in the first evaporator 15. In this situation, the control unit 26 may receive a signal from the sensor 51 along the return conduit 49 indicating that the liquid flow in the return conduit 49 has ceased. In response, to improve the efficiency of the WHR system 7, the control unit 26 may control the pump 25 to increase the flow of liquid state working fluid towards the first evaporator 15, until the sensor 51 indicates liquid flow in the return conduit 49.

Alternatively, or in addition, the control unit 26 may evaluate a signal from the temperature sensor 57 downstream of the second outlet 35 of the state separator 17, and may control operation of the pump 25 in dependence of the temperature of the vapor phase working fluid output from the state separator 17. When the temperature of the vapor state working fluid increases, the control unit 26 may control the pump 25 to increase the flow of liquid state working fluid towards the inlet 27 of the first evaporator 15.

Figure 3:
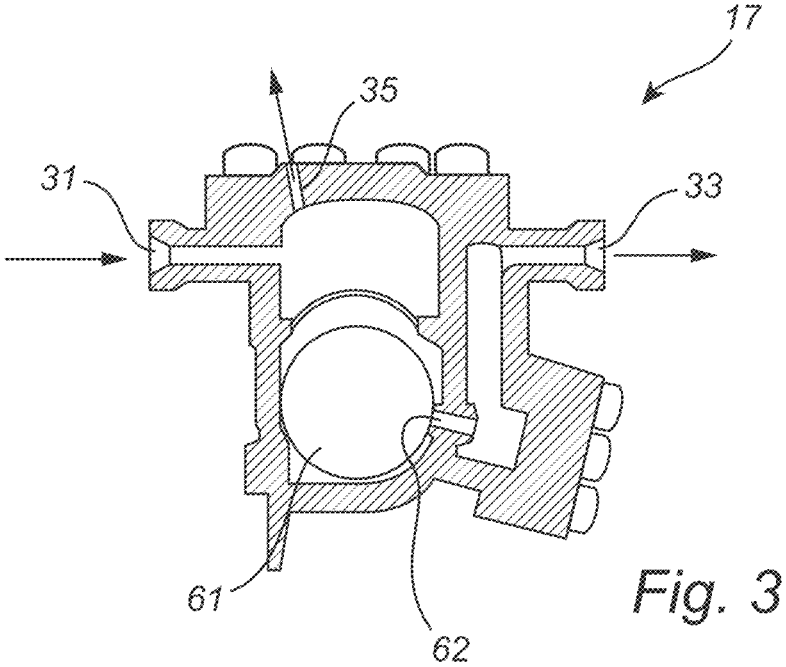
FIG. 3 schematically illustrates an example configuration of the state separator comprised in the waste heat recovery system in FIG. 2.

FIG. 3 schematically illustrates an example configuration of a state separator 17 comprised in the waste heat recovery system 7 in FIG. 2. Referring to FIG. 3, the state separator 17 comprises a float 61 and an orifice 62. When the level of liquid state working fluid is low in the state separator 17, the float 61 closes the orifice, preventing flow through the return conduit 49, and when the liquid level rises, the float 61 moves to unblock the orifice 62 so that liquid state working fluid can flow through the return conduit 49.

The different processes in a modified Rankine cycle representing the operation of the RC in a WHR system 7, but lacking a state separator, or state separator function, will now be described with reference to the T-S diagram 63 in FIG. 4. In the first process (1-2), liquid state working fluid is pumped, by the pump 25, from low to high pressure. In the second process (2-3), the liquid state working fluid is ultimately transformed to superheated vapor state working fluid. In the third process (3-4), the superheated vapor state working fluid expands through the expander 21, generating work. Finally, in the fourth process (4-1), the expanded vapor state working fluid enters the condenser 23, where it is condensed to liquid state working fluid. Such a system has a fixed efficiency possibility and is dependent on the capacity of the working fluid to absorb heat, the expander to extract work from that heat, and the condenser to shed heat un-used in the expander phase.

As is schematically indicated in FIG. 4, is modified such that the second process (2-3) takes place in two steps. In a first step (2-2'), the pressurized liquid state working fluid is partly transformed to vapor state working fluid in the first evaporator 15. The mix of vapor state working fluid and liquid state working fluid output by the first evaporator 15 is then separated by the state separator 17 into liquid state working fluid, which is returned (2'-1), and vapor state working fluid, which is input to the second evaporator 19, where it is then superheated (2'-3). This version of the RC can potentially have much greater efficiency owing to the higher temperature of the vapor phase working fluid entering the expander.

Figure 6:
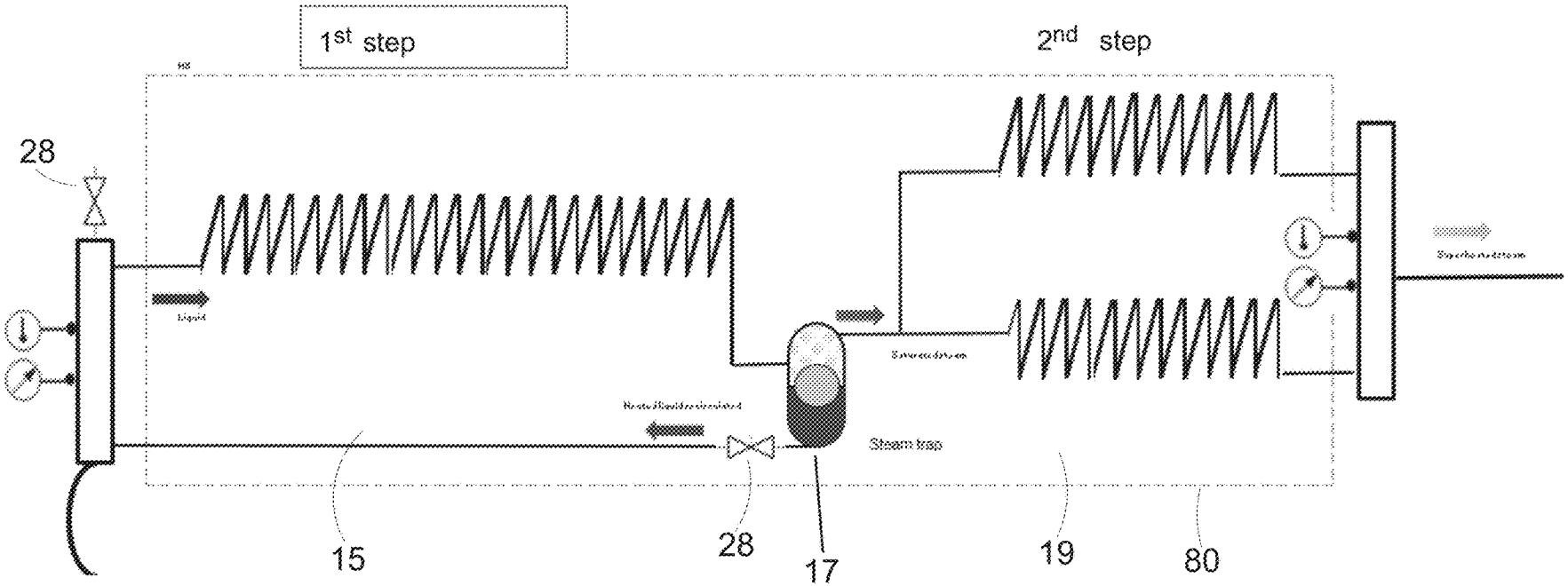
FIG. 6 is a schematic of a 2-stage evaporator including a state separator device/function as in the present invention in an initial phase of operation.
Figure 7:
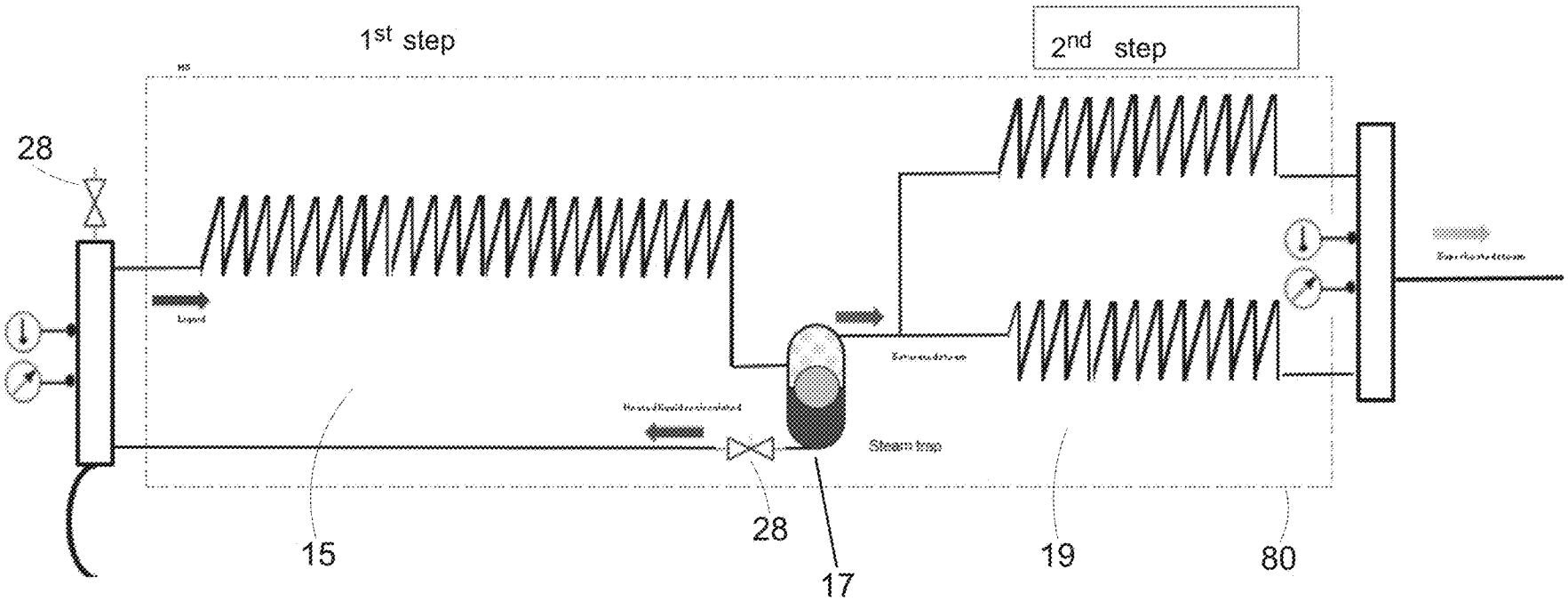
FIG. 7 is a schematic of a 2-stage evaporator including a state separator as in the present invention in a second phase of operation

FIGS. 6 and 7 are respective schematics showing a compact 2-stage evaporator for use in the modified RC shown in FIG. 5. Working fluid enters the first evaporator 15, first step, and is subject to heat from the surrounding exhaust gasses contained in chamber 80 of the exhaust system 5. The heated working fluid, mostly but not entirely in a vapor phase, is then separated by the state separator 17 into fluid for return to the first evaporator 15 inlet while the vapor is sent for further heating in the second evaporator 19, second step, also absorbing heat from surrounding exhaust gasses contained in chamber 80. Once super-heated, the vapor phase working fluid exits the second evaporator and is directed to a downstream expander 21. The working fluid flow in the system is controlled by valve(s) 28 responsive to control signals from the control unit 26.

Figure 8:
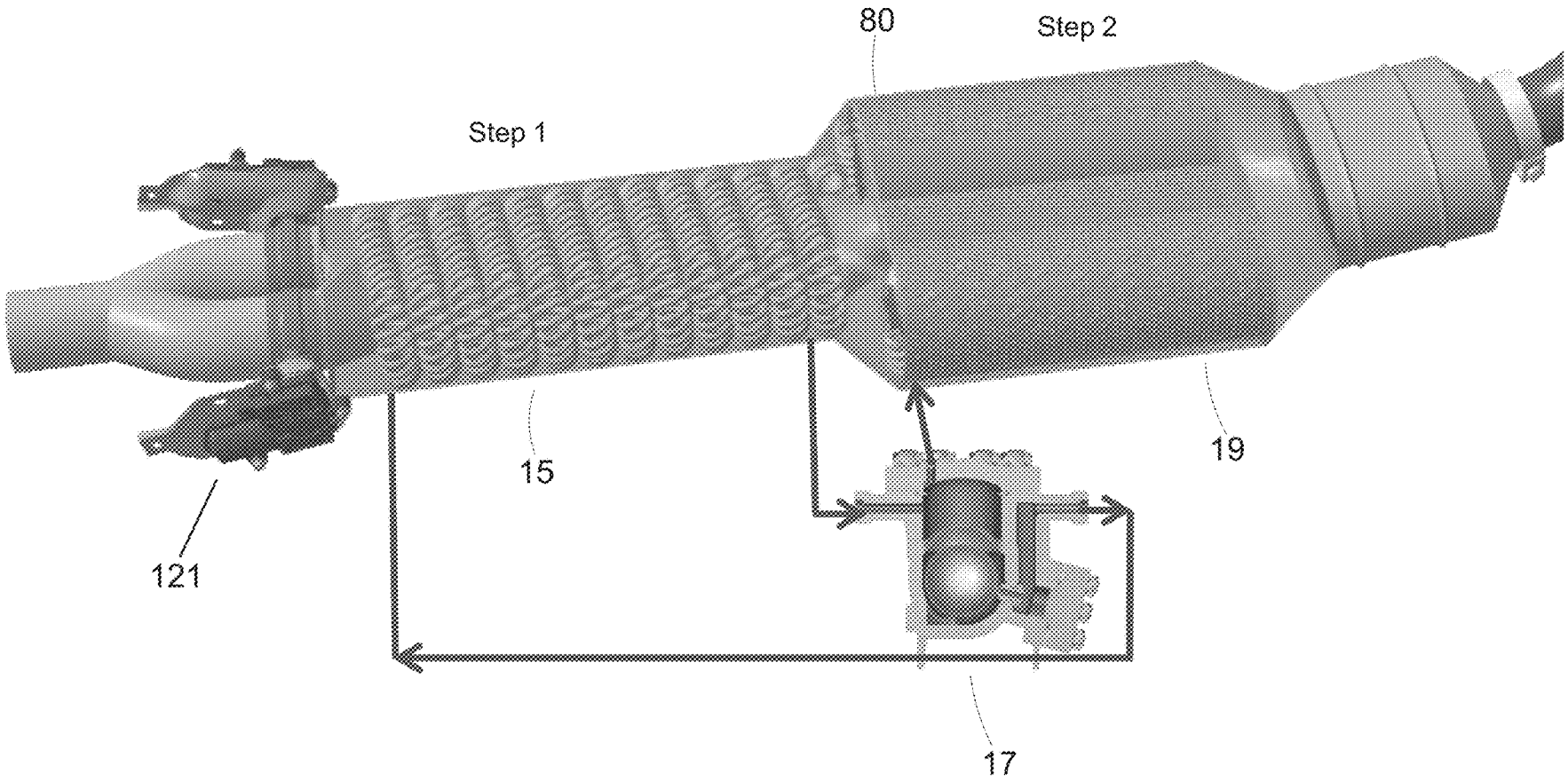
FIG. 8 is an embodiment of a 2-stage evaporator in accord with the present invention.

FIG. 8 shows an embodiment of the 2-stage evaporator having features in accord with the schematic shown in FIGS. 6 and 7. A containment chamber 80, made from metal tubing, for example, surrounds and contains passing exhaust gasses. The rate of containment or passing of the exhaust gasses through chamber 80 is controlled by butterfly valves 121 at the upstream and downstream ends of the 2-stage evaporator. In warm-up phases, for example, the exhaust gasses will be maintained and pressurized in the chamber 80 via the downstream butterfly valve, until a desired temperature is achieved, whereas during high demand, or shutdown, the butterfly valves 121, both up-stream and downstream, would be held fully opened. State separator 17 is connected in-line between the first 15 and second 19 evaporators' metallic coils so as to direct remaining fluid phase working fluid to return to the first evaporator 15 inlet.

Figure 9:
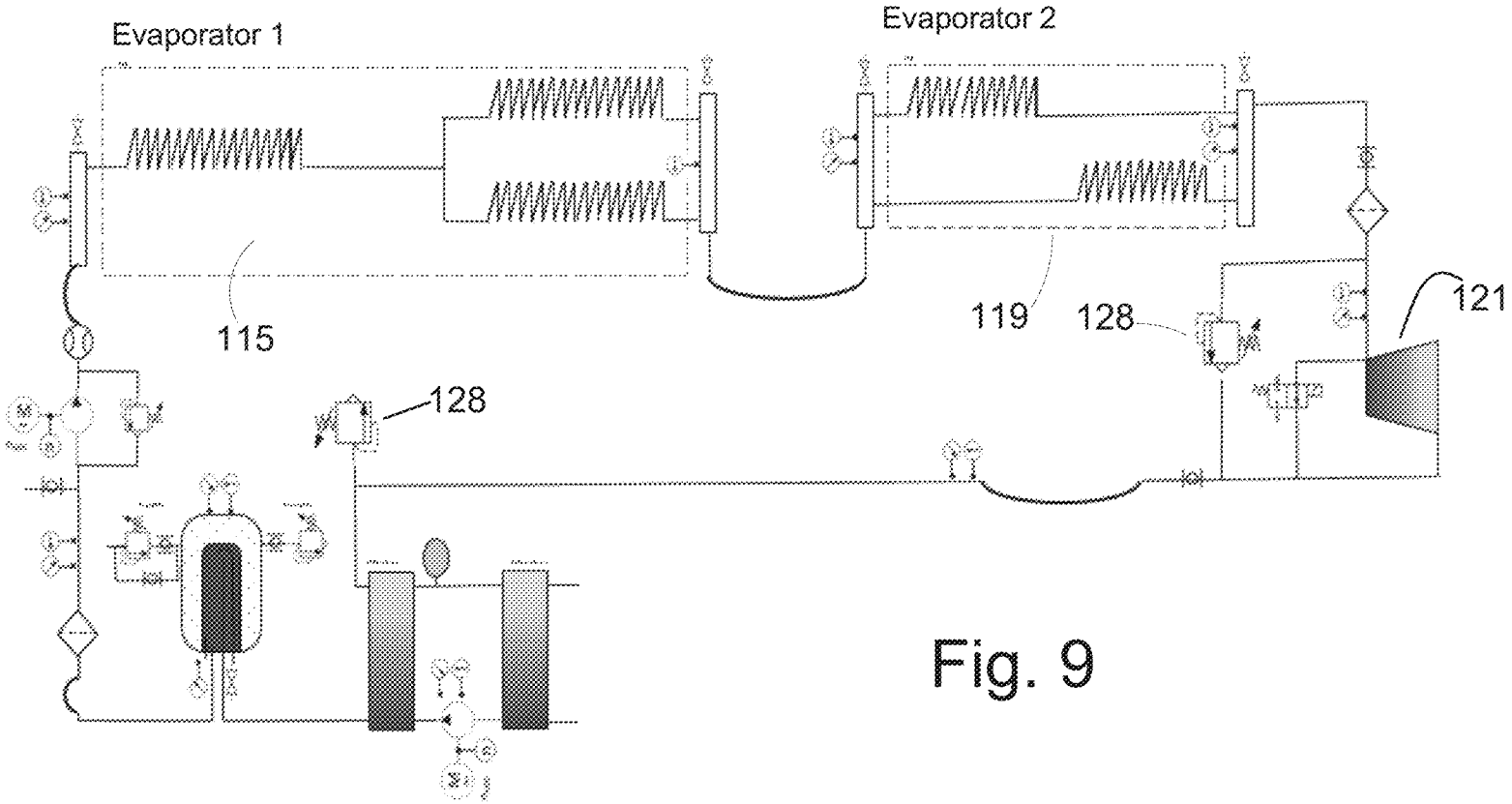
FIG. 9 is a schematic of an RC system including a 2-stage evaporator excluding a specific state separator device.

FIG. 9 shows another embodiment of a 2-stage evaporator in accord with the present invention. The respective first 115 and second evaporator 119 both serve the same function as in the prior embodiments, but in this embodiment, no state separator device is present. Rather, the first evaporator, itself, is sized and controlled to achieve vapor phase supply of working fluid to the second evaporator 119 and, where this has not been achieved, i.e., during start-up, the second evaporator 119, itself, can serve as a functional state separator with internal circulation and valving, to assure vapor phase only working fluid to a downstream expander 121. A further precaution is added with by-pass control valve 128 which would direct working fluid that had not reached sufficient temperature/vapor phase past the expander 121.

Figure 10A:
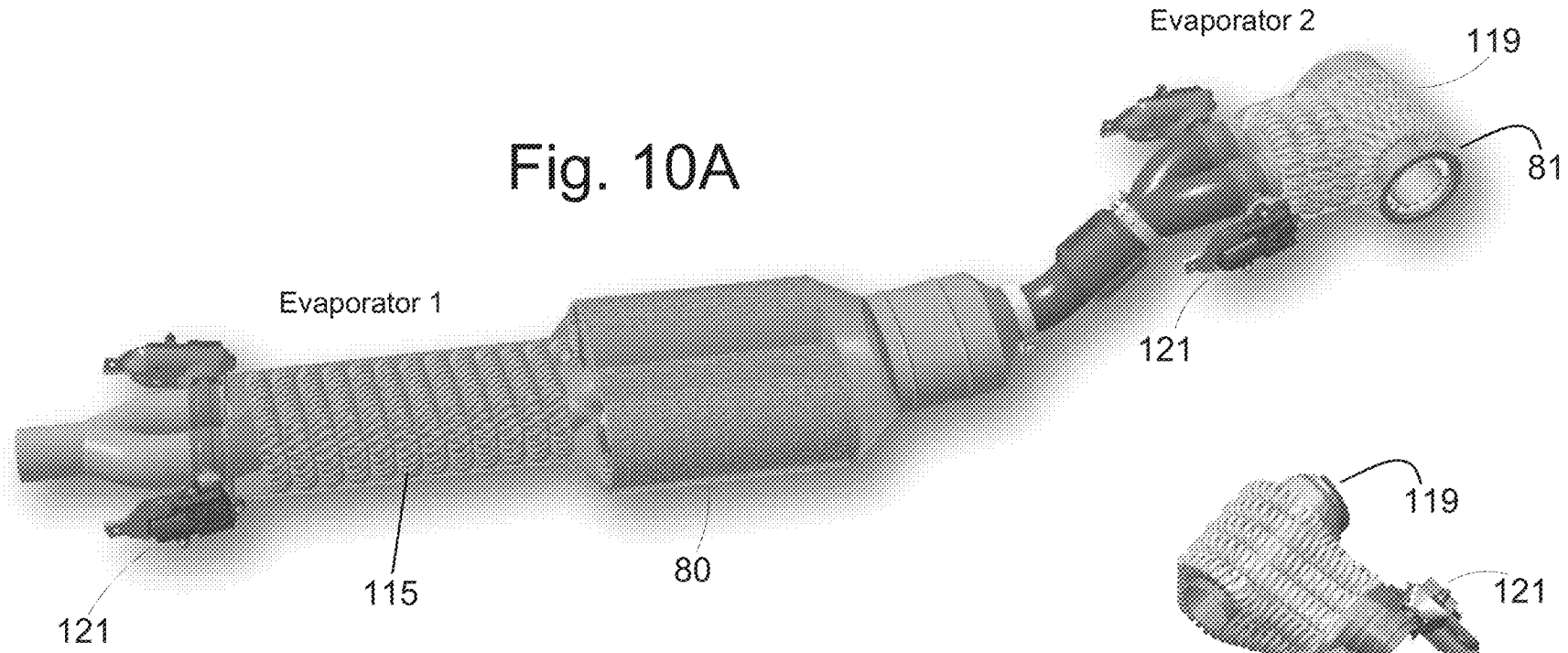
FIG. 10A is an embodiment of a 2-stage evaporator without a state separator device.
Figure 10B:
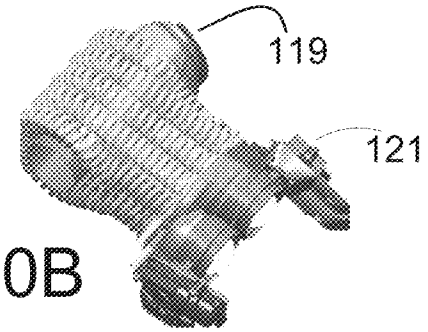
FIG. 10B is a detail of the second evaporator shown in FIG. 10A.

FIGS. 10A and 10B show an embodiment of the 2-stage evaporator that operates in accord with the schematic shown in FIG. 9. The respective evaporators 115 and 119 are separated in the device, with two chambers 80 and 81 providing separate heat sources to the respective evaporators/coils. Exhaust gas pressurization is controlled by butterfly valves 121 up and downstream from the device and are operated in accord with signals from control unit 26. During ICE warm-up, for example, the upstream valves 121 would be restricted to concentrate heat to the second evaporator, whereas during high ICE demand, the upstream valves would be held open and the downstream first evaporator would likely provide sufficient heat to obtain necessary vapor phase operation of the RC system.

The person skilled in the art realizes that the present invention by no means is limited to the preferred embodiments described above. On the contrary, many modifications and variations are possible within the scope of the appended claims. For example, the vehicle 1 need not be powered only by an ICE 3, but may be a hybrid vehicle, or a purely electric vehicle, which may be powered by batteries and/or fuel-cells. Furthermore, the vehicle heat sources need not be related to the propulsion of the vehicle 1, but may be related to auxiliary systems, such as a vehicle climate system etc.

The foregoing description of the exemplary embodiments of the present invention has been presented for the purpose of illustration in accordance with the provisions of the Patent Statutes. It is not intended to be exhaustive or to limit the invention to the precise forms disclosed. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

What is claimed is:

1. A two-stage waste heat recovery device (7), adapted for installation as an integral part of an exhaust system of a vehicle equipped with an IC Engine, for transferring thermal energy from waste heat from exhaust gasses passing through the device to a working fluid also passing through the device; comprising:

a waste heat inlet configured to accept said exhaust gasses from said IC Engine, and a waste heat outlet and at least one waste heat containment chamber forming a part of said exhaust system and containing said exhaust gasses connected between the waste heat inlet and the waste heat outlet;

a first evaporator (15), contained within the containment chamber, having a first working fluid inlet (27) for receiving liquid state working fluid and a first outlet (29) for output of a saturated vapor state of the working fluid;

a second evaporator (19), also contained within the chamber, the second evaporator (19) having a second inlet (37) for receiving the working fluid from the first outlet (29) of the first evaporator, the second evaporator having a second outlet (39) for output of a superheated vapor state of the working fluid;

a state separator (17), for separating vapor state working fluid and liquid state working fluid, connected between the respective first and second evaporators, the state separator (17) having a separator inlet (31) connected to the first outlet (29) of the first evaporator (15), and a first separator outlet (33), for connecting to and providing liquid state working fluid to the first working fluid inlet (27) of the first evaporator (15), and a second separator outlet (35) for output of vapor state working fluid to the inlet (37) of the second evaporator.

2. A two-stage waste heat recovery device (7) according to claim 1, wherein the first outlet (33) of the state separator (17) is fluid flow connected to the inlet (27) of the first evaporator (15) via a pump (25).

3. A two-stage waste heat recovery device (7) according to claim 2, wherein the state separator (17) is configured to separate vapor state working fluid and liquid state working fluid based on density.

4. A two-stage waste heat recovery device (7) according to claim 3, further comprising a sensor (51) for providing a signal indicative of mass flow of liquid state working fluid from the first outlet (33) of the state separator (17) to the inlet (27) of the first evaporator (15).

5. A two-stage waste heat recovery device (7) according to claim 4, wherein the sensor (51) is a liquid sensor arranged between the first outlet (33) of the state separator (17) and the inlet (27) of the first evaporator (15) and configured to sense a presence of liquid state working fluid flowing out of the first outlet (33) of the state separator (17).

6. A two-stage waste heat recovery device according to claim 1, wherein the working fluid is a mixture of a first fluid having a first boiling temperature at a given pressure, and a second fluid having a second boiling temperature at the given pressure.

7. A two-stage waste heat recovery device (7), adapted for installation as an integral part of exhaust system of a vehicle equipped with an IC Engine, for transferring thermal energy from the waste heat from exhaust gasses from said IC Engine passing through the device to a working fluid also passing through the device; comprising:

a waste heat inlet and a waste heat outlet and at least two separated waste heat containment chambers forming a portion of said exhaust system and containing said exhaust gasses connected between the waste heat inlet and waste heat outlet;

a first evaporator (15) contained within a first one of the chambers, the first evaporator (15) having a first working fluid inlet (27) for receiving liquid state working fluid and a first outlet (29) for output of a saturated vapor state of the working fluid;

a second evaporator (19), contained within a second one of the chambers, the second evaporator (19) having a second inlet (37) for receiving the working fluid from the first outlet (29) of the first evaporator, the second evaporator having a second outlet (39) for output of a superheated vapor state of the working fluid; and, state separator means for separating vapor state working fluid and liquid state working fluid, said state separator means connected to the respective first and second evaporators preventing liquid state working fluid from exiting the second evaporator.

8. A two-stage waste heat recovery device (7) according to claim 7, the state separator means is fluid flow connected to the inlet (27) of the first evaporator (15) via a pump (25).

9. A two-stage waste heat recovery device (7) according to claim 8, wherein the state separator means is configured to separate vapor state working fluid and liquid state working fluid based on density of the working fluid.

10. A two-stage waste heat recovery (7) according to claim 9, further comprising a sensor (51) for providing a signal indicative of mass flow of liquid state working fluid from the first outlet (33) of the first evaporator (15).

11. A two-stage waste heat recovery device (7) according to claim 10, wherein the sensor (51) is a liquid sensor arranged at the outlet (33) of the second evaporator (15) and configured to sense a presence of liquid state working fluid flowing therethrough.

12. A two-stage waste heat recovery device according to claim 7, wherein the working fluid is a mixture of a first fluid having a first boiling temperature at a given pressure, and a second fluid having a second boiling temperature at the given pressure.

13. A vehicle (1), comprising:

a first vehicle heat source (16);

a second vehicle heat source (18), spaced apart from the first vehicle heat source; and, a waste heat recovery device including respective first and second evaporators associated with the respective first and second heat sources (7), wherein:

the first evaporator (15) of the waste heat recovery system is in a containment chamber in thermal contact with the first vehicle heat source (16); and the second evaporator (19) of the waste heat recovery device is in in a second containment chamber in thermal contact with the second vehicle heat source (18); and, a state separator connected between the respective first and second evaporators to separate fluid from vapor in a working fluid in a saturated state passing from the first to the second evaporator, wherein heat provided by the heat sources is imparted to the working fluid via the respective evaporators and said working fluid departs from said second evaporator in a superheated state, wherein;

the vehicle comprises an internal combustion engine (3) and an exhaust system (5);

the first vehicle heat source (16) is constituted by a first portion of the exhaust system (5); and the second vehicle heat source (18) is constituted by a second portion of the exhaust system (5) and the respective first and second containment chambers form portions of said exhaust system.

14. The vehicle (1) according to claim 13, wherein the second portion (18) of the exhaust system (5) is upstream of the first portion (16) of the exhaust system (5).

15. A vehicle (1) according to claim 13, further comprising:

at least one butterfly valve positioned within the exhaust system (5) so as to control the rate of thermal contact of passing exhaust gasses with the first and second evaporators.

16. The vehicle according to claim 13, further comprising:

a control system, for controlling flow of the working fluid in the evaporators, electrically connected to a sensor (51), for sensing fluid flow at a fluid outlet of the separator, and to a pump (25), and configured to:

acquire, from the sensor (51), a signal indicative of mass flow of liquid state working fluid from the outlet (33) of the state separator (17); and, control the pump (25) to supply a sufficient mass flow of liquid state working fluid to an inlet (27) of the first evaporator (15) to make mass flow of liquid state working fluid from the first outlet (33) of the state separator (17) to the inlet (27) of the first evaporator (15) greater than zero.

17. The vehicle (1) according to claim 16, wherein the second portion (18) of the exhaust system (5) is upstream of the first portion (16) of the exhaust system (5).

18. The vehicle according to claim 16, wherein the working fluid is a mixture of a first fluid having a first boiling temperature at a given pressure, and a second fluid having a second boiling temperature at the given pressure.

* * * * *